US007179058B2

(12) United States Patent
Chandraker

(10) Patent No.: US 7,179,058 B2
(45) Date of Patent: Feb. 20, 2007

(54) AERODYNAMICALLY WIDE RANGE APPLICABLE CYLINDRICAL BLADE PROFILES

(75) Inventor: Amrit Lal Chandraker, Hyderabad (IN)

(73) Assignee: Bharat Heavy Electricals Limited (IN)

( * ) Notice: Subject to any disclaimer, the term of this patent is extended or adjusted under 35 U.S.C. 154(b) by 0 days.

(21) Appl. No.: 10/861,602

(22) Filed: Jun. 4, 2004

(65) Prior Publication Data

US 2005/0207893 A1 Sep. 22, 2005

(30) Foreign Application Priority Data

Mar. 31, 2004 (IN) ..... 652/DEL/2004

(51) Int. Cl.
*F01D 5/14* (2006.01)

(52) U.S. Cl. ..... 416/223 A; 416/DIG. 2; 416/DIG. 5

(58) Field of Classification Search ..... 416/243, 416/242, 238, 223 A, DIG. 2, DIG. 5; 415/191
See application file for complete search history.

(56) References Cited

U.S. PATENT DOCUMENTS 2,415,847 A * 2/1947 Redding ..... 416/219 R
3,333,817 A * 8/1967 Rhomberg ..... 416/242
3,565,548 A * 2/1971 Fowler et al. ..... 416/223 R
4,695,228 A * 9/1987 Purcaru ..... 416/223 A
5,035,578 A * 7/1991 Tran ..... 416/223 A
5,192,190 A 3/1993 Ferleger et al.
5,211,703 A 5/1993 Ferleger et al.
6,709,239 B2 * 3/2004 Chandraker ..... 416/238
6,739,838 B1 * 5/2004 Bielek et al. ..... 416/223 A
6,802,695 B2 * 10/2004 Haller ..... 416/223 R
2003/0231961 A1 * 12/2003 Chandraker ..... 416/243

* cited by examiner

*Primary Examiner*—Edward K. Look
*Assistant Examiner*—Nathan Wiehe
(74) *Attorney, Agent, or Firm*—The Webb Law Firm

(57) ABSTRACT

The present invention relates to the improved aerodynamic design of a pair of blade profiles valid over a wide range of flow regime. The so formed blades, pertain to high pressure, intermediate pressure and first few stages of low pressure cylinders of axial steam turbines.

The invented blades cover a wide range of stagger angles; pitch/chord ratios; inlet flow angles and outlet Mach numbers.

2 Claims, 9 Drawing Sheets

PROFILE GEOMETRY DESCRIPTION (BASE PROFILE)

Fig.1 PROFILE GEOMETRY DESCRIPTION (BASE PROFILE)
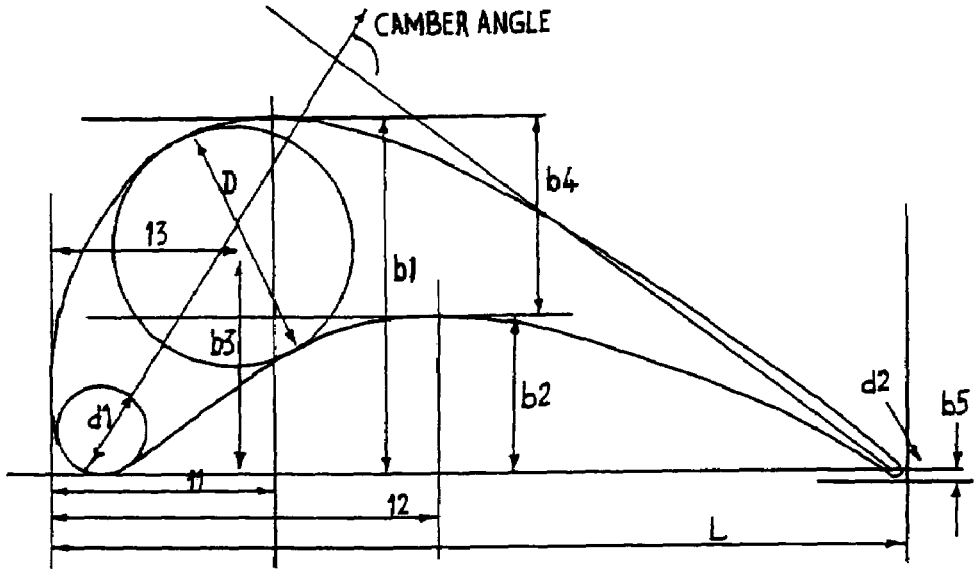
Fig.2 PROFILE GEOMETRY DESCRIPTION (STACKED PROFILE)
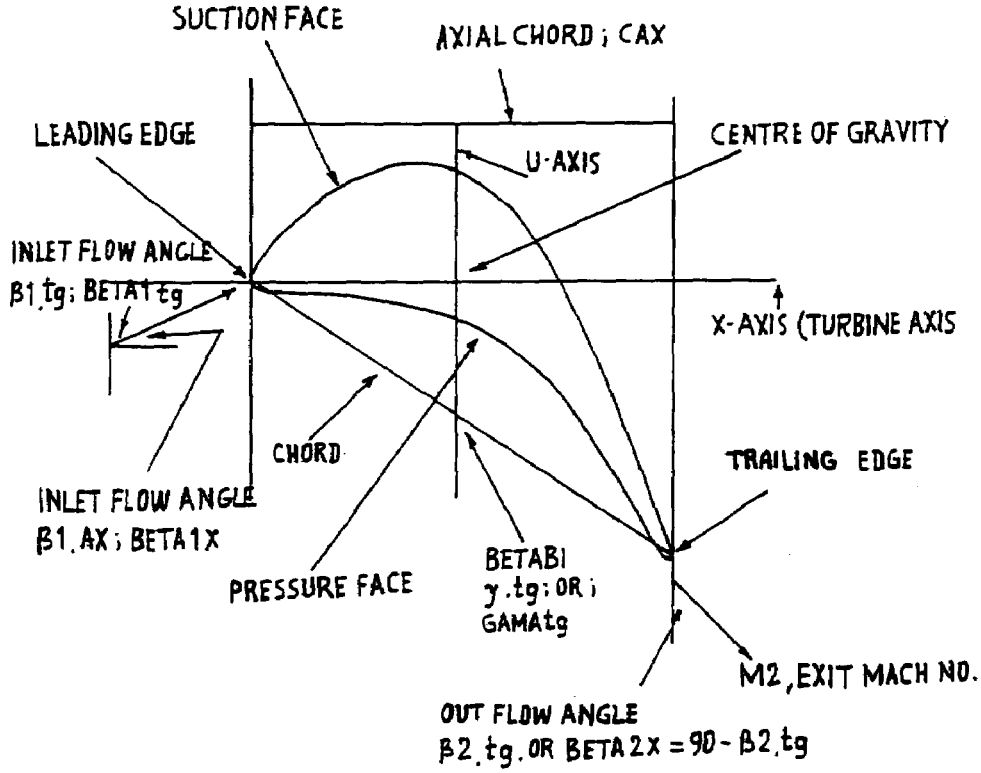

Fig. 3 e3 PROFILE : GEOMETRICAL RATIO
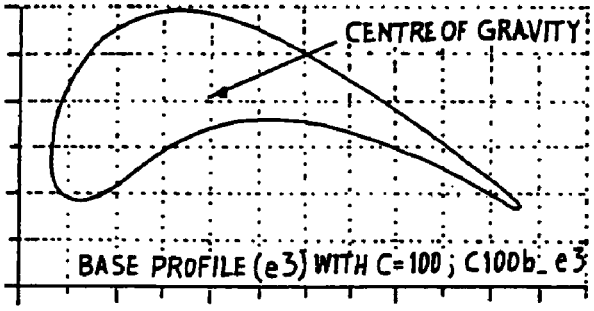
D/L = 0.2766223
d1/L = 9.5747955E-02
d2/L = 1.3889720E-02
b1/L = 0.4093767
b2/L = 0.1795354
b3/L = 0.2625337
b4/L = 0.2298413
b5/L = 1.4287546E-02
l1/L = 0.2615605
l2/L = 0.4520896
l3/L = 0.2197523
A/(D*L) = 0.6120743
CAMBER ANGLE 94.5 DEGREE
Fig. 4 e3 PROFILE (STACKED VIEW)
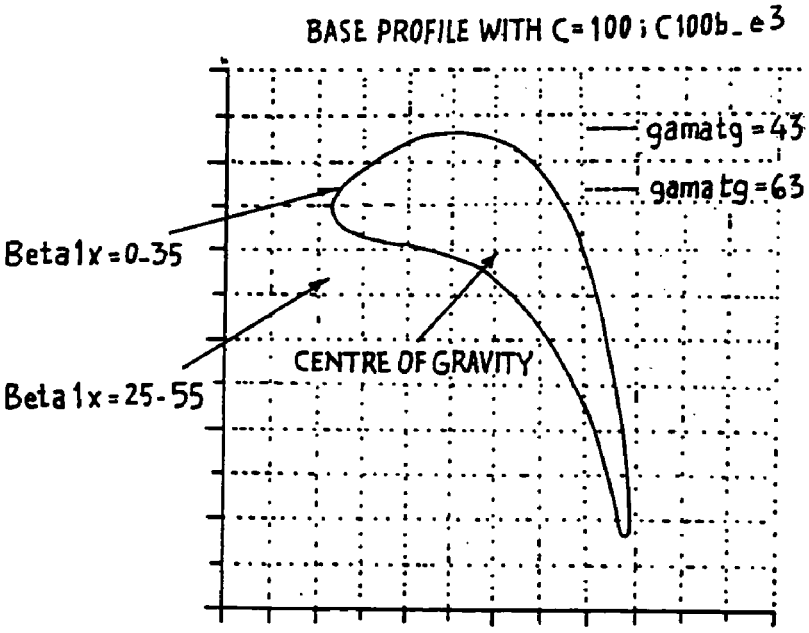

Fig. 5 e3 PROFILE : LOSS CHARACTERISTICS AS FUNCTION OF M2, S/C & GAMAtg
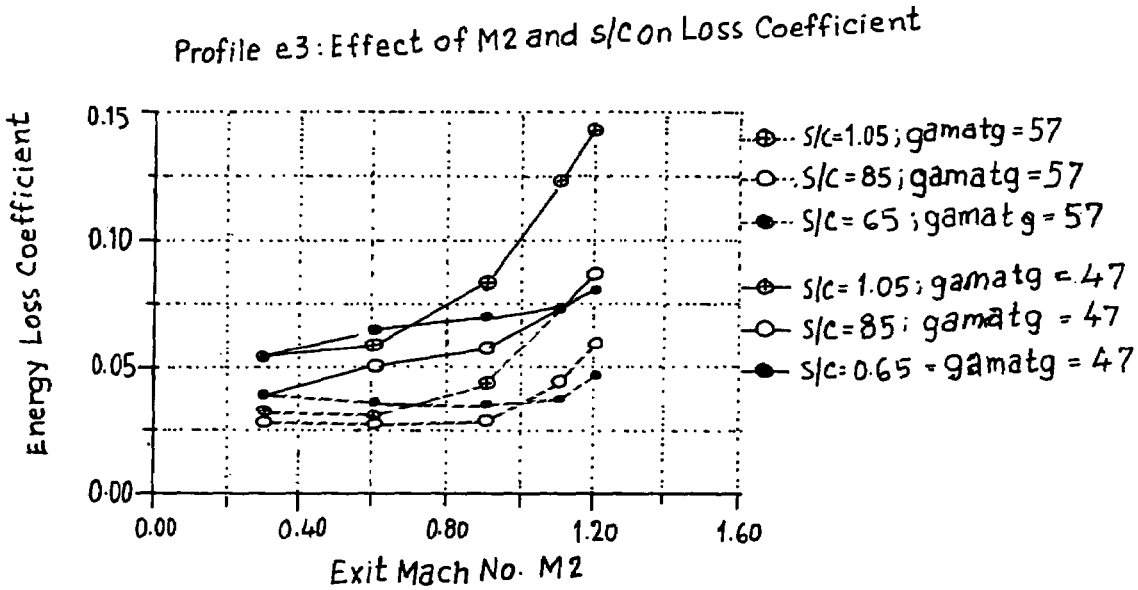
Fig. 6 e3 PROFILE : OUTLET FLOW ANGLES AS FUNCTION OF M2, S/C & GAMAtg
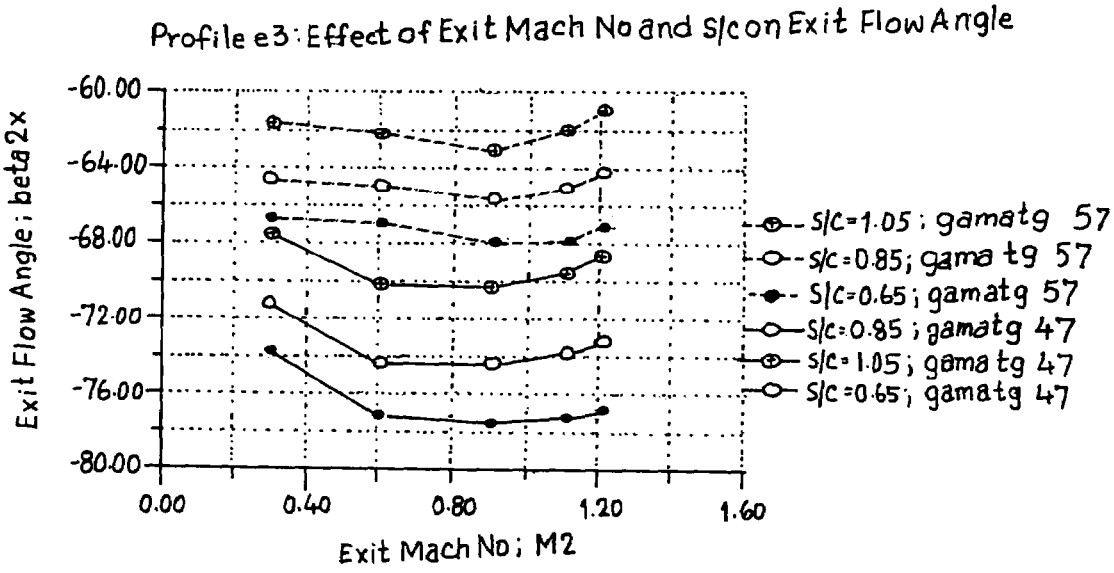

Fig. 7 e 3 PROFILE : LOSS CHARACTERISTICS AS FUNCTION OF INLET ANGLE & GAMAtg
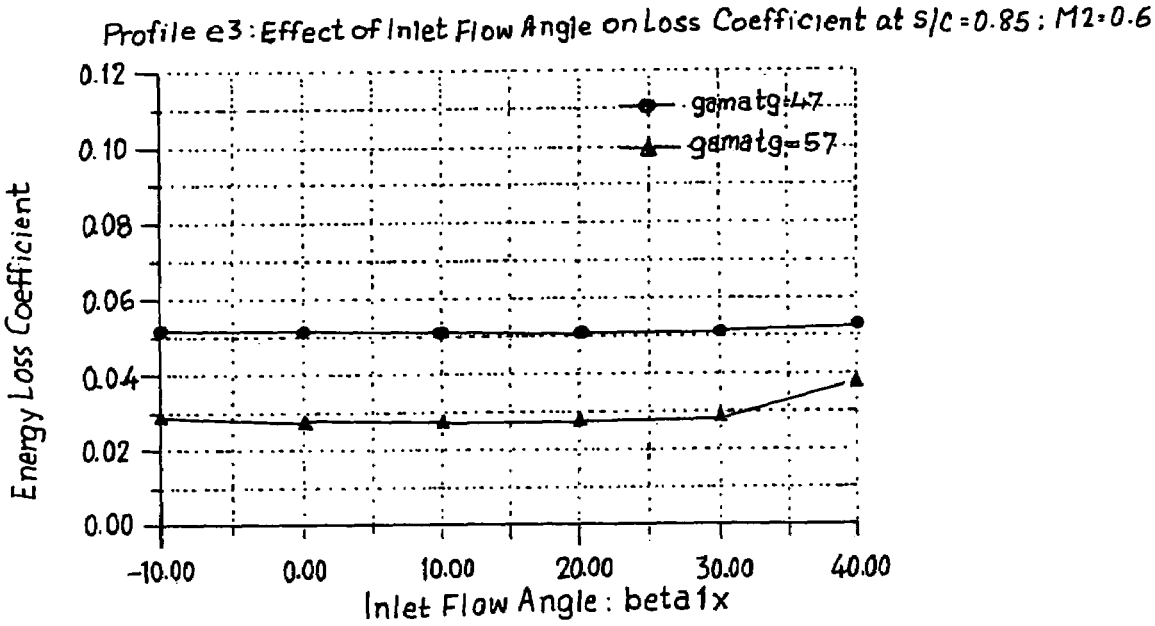
Fig. 8 e3 PROFILE : OUTLET FLOW ANGLE AS FUNCTION OF INLET ANGLE & GAMAtg
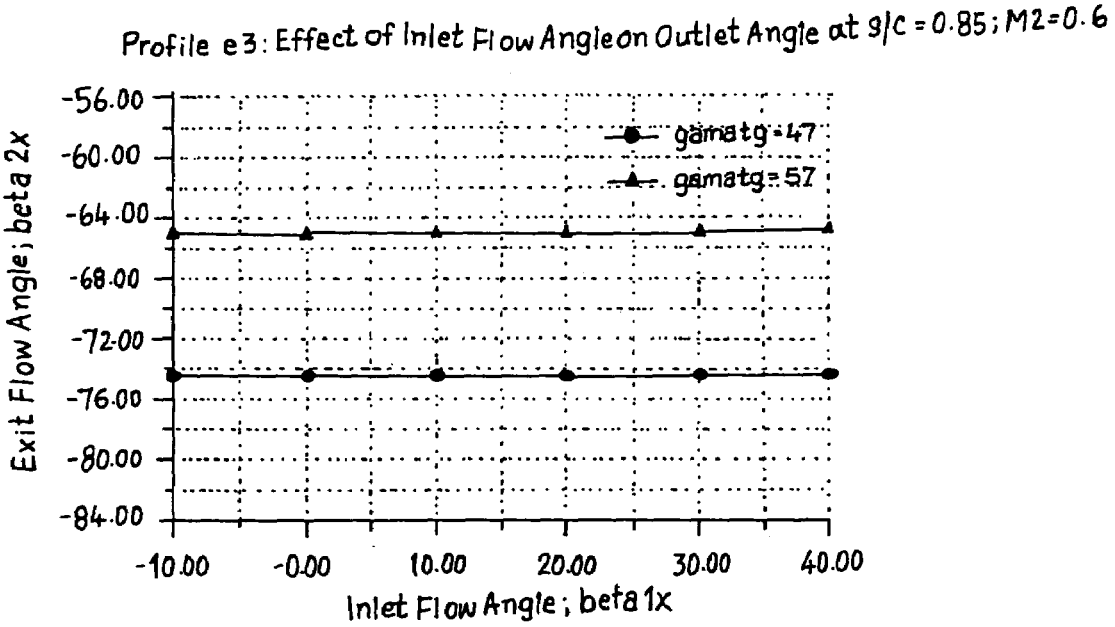

Fig. 9 e3 PROFILE : LOSS CHARACTERISTICS AS FUNCTION OF GAMAtg & M2
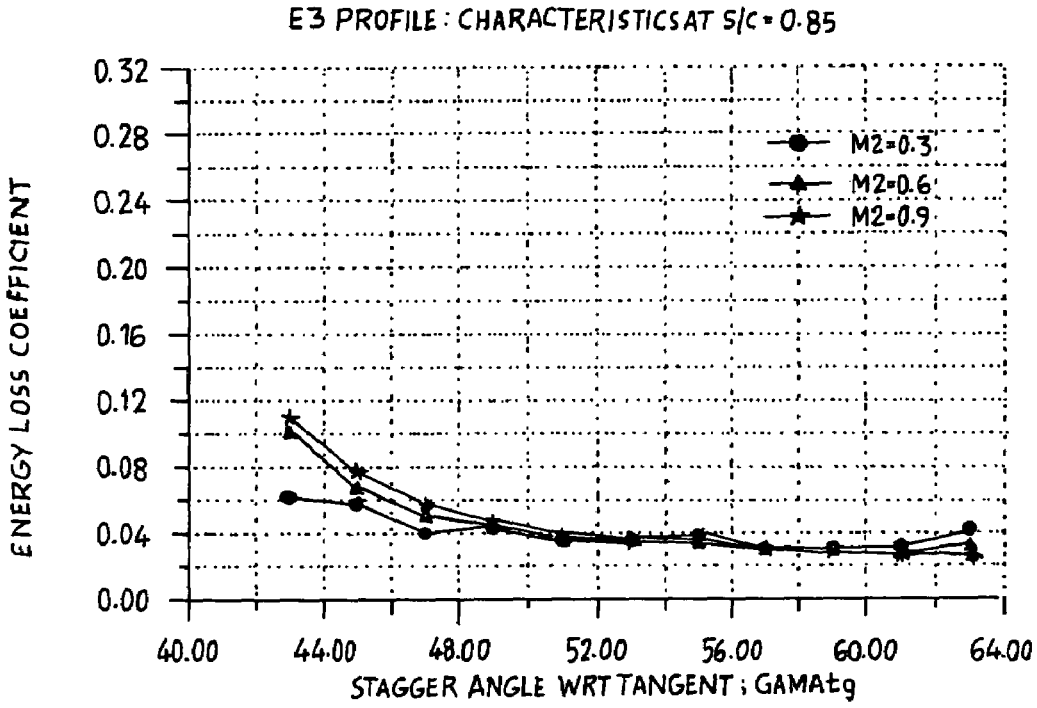
Fig. 10 e3 PROFILE : OUTLET FLOW ANGLE AS FUNCTION OF GAMAtg & M2
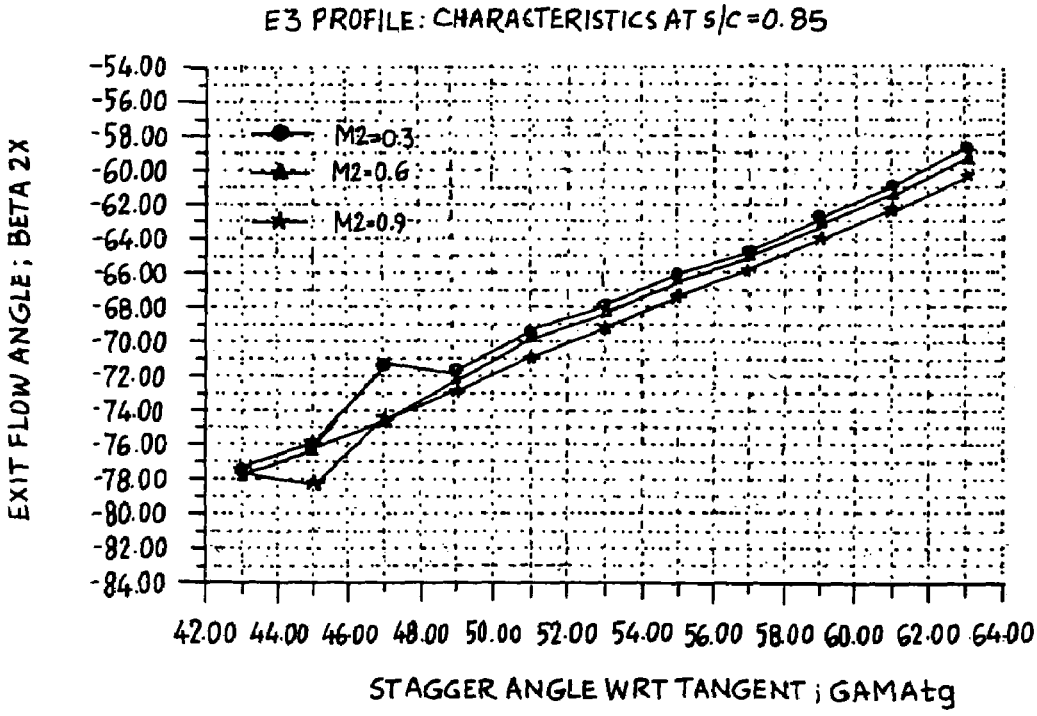

Fig. 11 e9 PROFILE : GEOMETRICAL RATIOS
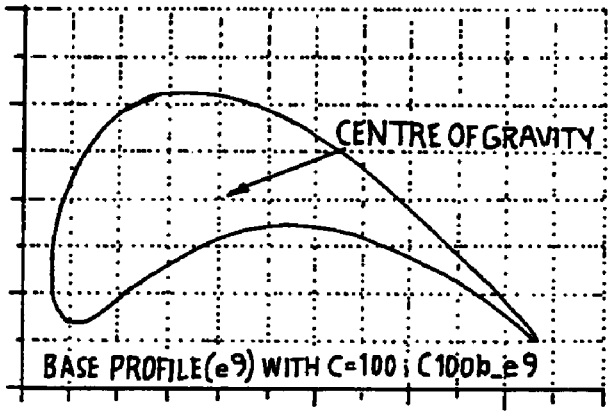
D/L = 0.329558
d1/L = .051
d2/L = .006
b1/L = 0.49078
b2/L = 0.212665
b3/L = 0.321576
b4/L = 0.27812
b5/L = 0.0268
l1/L = 0.277689
l2/L = 0.49412
l3/L = 0.2460
A/(D*L) = 0.63114
Camber angle 110 deg.
Fig. 12 e9 PROFILE (STACKED VIEW)
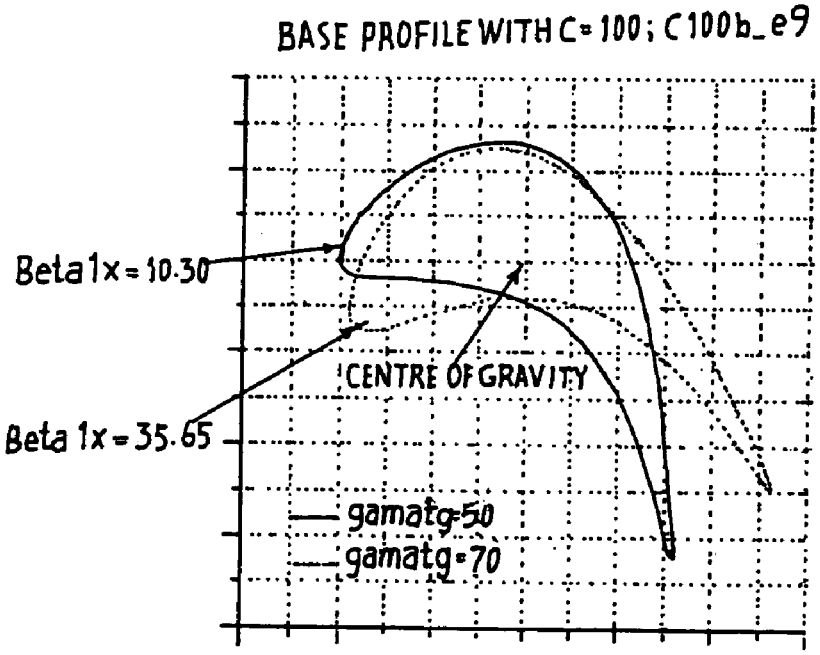

Fig. 13 e9 PROFILE : LOSS CHARACTERISTICS AS FUNCTION OF INLET ANGLE & GAMAtg
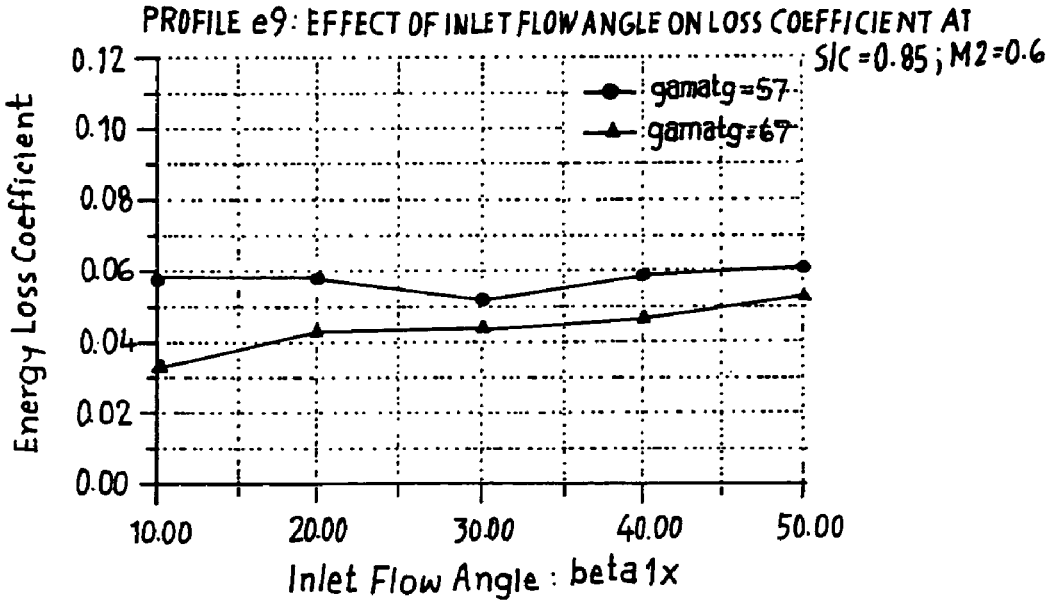
Fig. 14 e9 PROFILE : OUTLET FLOW ANGLE AS FUNCTION OF INLET ANGLE & GAMAtg
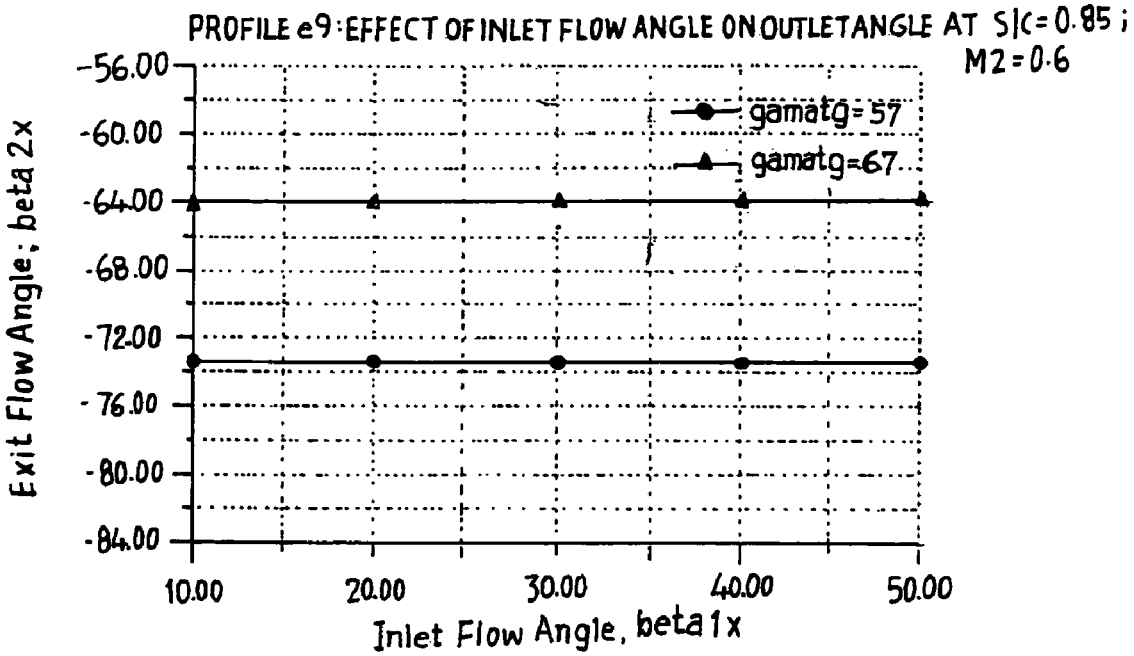

Fig. 15 e9 PROFILE : LOSS CHARACTERISTICS AS FUNCTION OF M2 S/C & GAMAtg
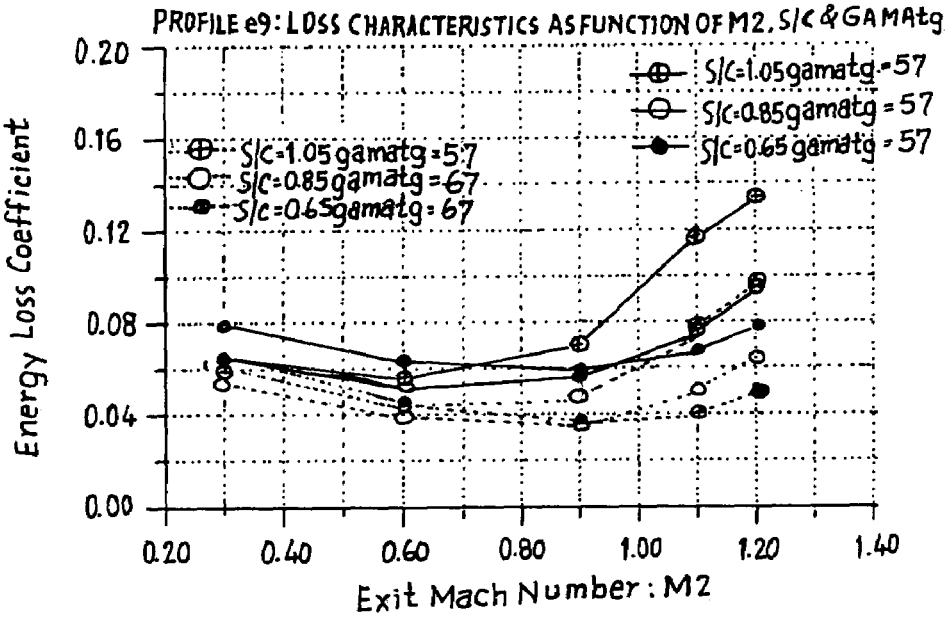
Fig. 16 e9 PROFILE : OUTLET FLOW ANGLES AS FUNCTION OF M2, S/C & GAMAtg
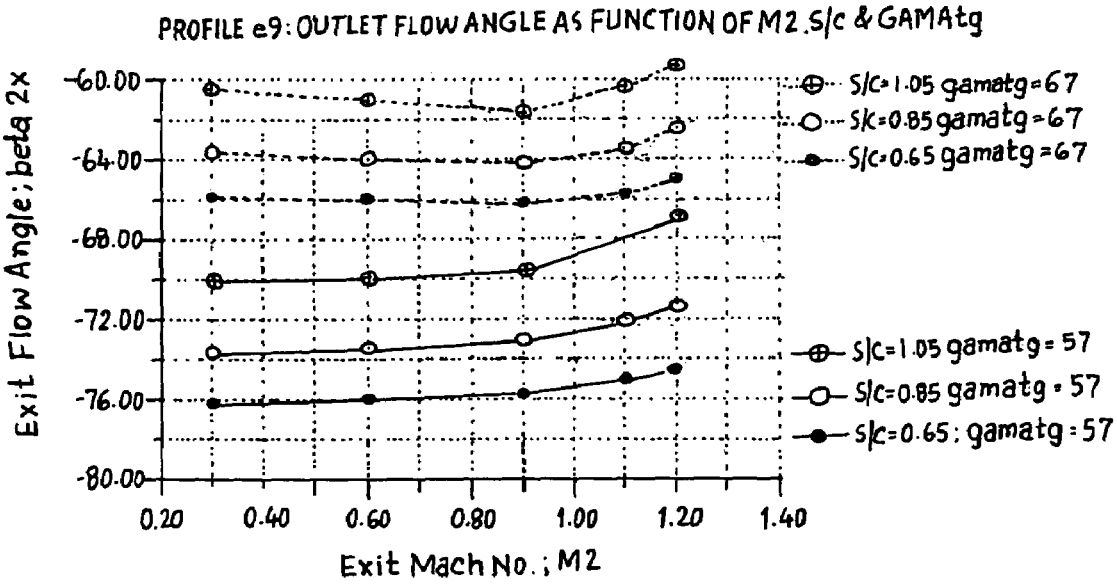

Fig. 17 e9 PROFILE : LOSS CHARACTERISTICS AS FUNCTION OF GAMAtg & M2
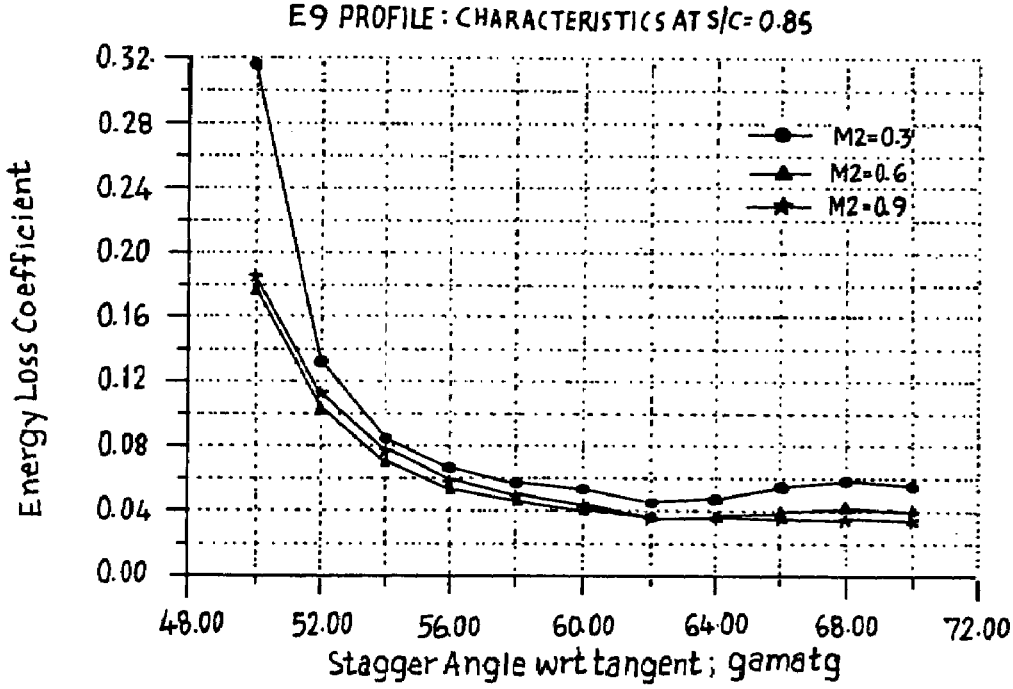
Fig. 18 e9 PROFILE : OUTLET FLOW ANGLE AS FUNCTION OF GAMAtg & M2
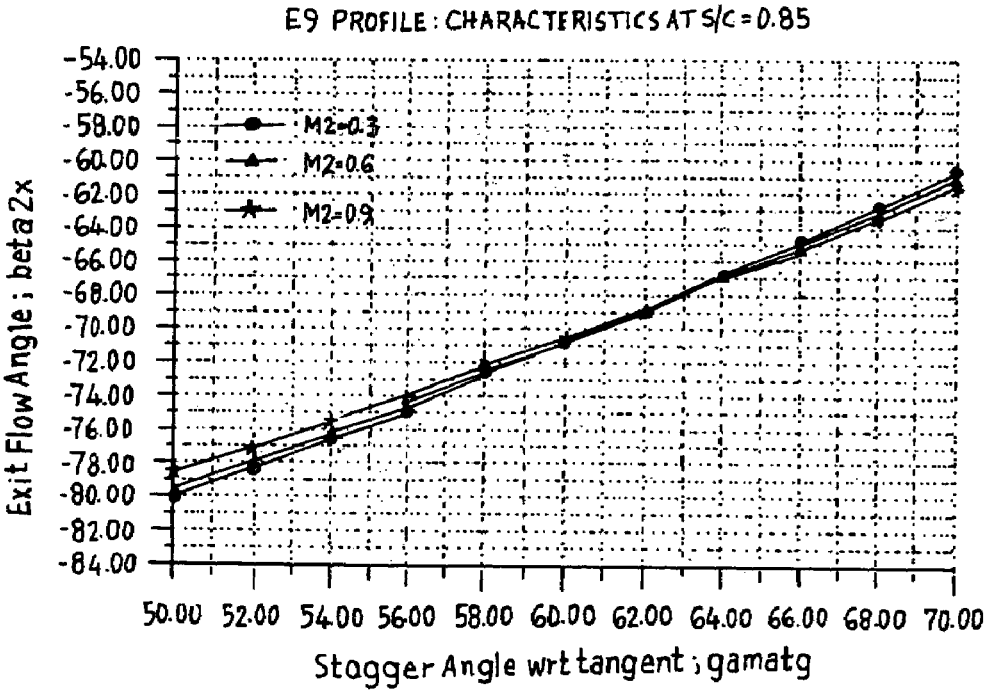

AERODYNAMICALLY WIDE RANGE APPLICABLE CYLINDRICAL BLADE PROFILES

FIELD OF INVENTION

This invention relates to aerodynamically wide range applicable cylindrical blade profiles for axial steam turbines.

BACKGROUND OF THE INVENTION AND PRIOR ART

The designers of steam turbines seek for quick selection of useful blades with a minimum number of inventory. One would prefer a few efficient blades to cover a wide flow range prevailing in turbine stages. There are publications such as Deich et al. (Atlas of Blades Profiles for Axial Turbines 1965) for a set of profiles. Further, two patents U.S. Pat. No. 5,211,703 (1993) and U.S. Pat. No. 5,192,190 (1993) on stationary blade have been filed by the authors, viz. Ferteger, Jurek and Evans, David H. Such patents were for a twisted stationary blade with varying stagger angle from hub to tip (from 42 deg at hub to 52 deg at shroud). The blade is non-cylindrical and twisted over the span. A recent patent by the present author (U.S. Pat. No. 6,709,239) is for design of three dimensional twisted blade for use in entry stages of HP/IP cylinders of axial steam turbines. A related patent by Purcaru et al. (U.S. Pat. No. 4.695.228) deals with the construction of profiles through ellipse, parabola and circle segments. The present author has also filed an application (Pub. No. U.S. 2003/0231961A1, U.S. Pat. No. 6,979,178B2) for two cylindrical profiles for subsonic flow application and for a specified range of stagger angles. One of the profiles, P2822 is the reference profile for the present invention which concerns with a new blade profile; that can be used for forming a cylindrical blade i.e. with constant stagger from hub to tip. The blades formed by this profile are untwisted or cylindrical in shape. In addition, the present invention deals with both stationary (guide) and rotating (moving) type of blades for axial steam turbines.

While converting heat energy into kinetic energy, turbines blades suffer two kinds of aerodynamic losses; one—the profile loss due to stream wise boundary layer growth (along blade surfaces), and, mixing in blade wakes, the second—the profile loss due to secondary flow resulting from boundary layer growth along the hub and casing and flows resulting from turning of inlet boundary layer (passage vortex; pressure face to suction face in a cascade passage). The reduction in losses is achieved by various means such as smooth surface and aft-loaded pressure distribution along the blade surfaces (instead of fore-loaded or flat-topped design). Smooth contour variation usually ensures lower profile losses for incompressible and subsonic flows. The lower velocity and cross-channel pressure gradient in the first part of cascade passage where the secondary flow originates; and higher diffusion in the rear part of suction face are the desired features in aft-loaded profiles which in turn reduces secondary flow losses.

The cylindrical blade is defined herein as one of constant cross-section over the blade height. FIG. 1 shows a schematic base profile. At any cross-section, the shape of the profile remains same as shown typically in FIG. 2. The profile or section is made of two surfaces; suction face and pressure face, each joining leading edge to trailing edge. X-axis and U-axis coincide with the turbine axis and circumferential directions, respectively. Usually the center of gravity lies at the origin of co-ordinate axes. The blade or profile is set at angle betabi or y, tg, also known as stagger or setting angle with respect of U-axis. Chord is defined as axial distance of base profile measured between two farthest tangents to the profile; one at leading edge side and other at trailing edge side. The tangents are normal to the chord. Axial chord is the projected length of the profile on X-axis; hence varies with profile stagger. Inlet and exit flow angles β1, tg and β2, tg are fluid flow angles with respect to tangent (U-axis); also referred as beta 1*x* and beta 2*x* with reference to turbine axis, respectively. The profile faces can be specified by various ways; e.g. through discrete points (x, y co-ordinates), through a set of arcs and through Bezier points. The basic difference between any two cylindrical blades is the profile shape and what is being claimed here is the unique quantitative shape of the proposed blade (e.g. geometrical ratios as shown in FIG. 3).

OBJECTS OF THE INVENTION

An object of the present invention is to propose an aerodynamic efficient blade profile and relate and complement with another profile from application point of view.

Another object of the present invention is to propose an aerodynamic efficient blade profile which is applicable for a wide stagger variation.

Still another object of the present invention is to propose an aerodynamic efficient blade profile and wherein tooling is minimum.

DESCRIPTION OF THE INVENTION

According to this invention there is provided two cylindrical blades for axial steam turbines comprising a leading edge and a trailing edge with specified circles and a pressure face and suction face and joining at said trailing and leading edges and an inlet flow angle characterized in that the trailing edge is below the base line.

BRIEF DESCRIPTION OF DRAWINGS

The nature of invention, its objective and further, advantages residing in the same will be apparent from the following description made with reference to the non-limiting exemplary embodiments of the invention represented in the accompanying drawings.

FIG. 1 Profile Geometry Description (Base Profile)

FIG. 2 Profile Geometry Description (Stacked Profile)

FIG. 3 e3 Profile: Geometrical Ratios

FIG. 4 e3 Profile: (Stacked View)

FIG. 5 e3 Profile: Loss characteristics as function of M2, S/c & gamatg FIG. 6 e3 Profile: Outlet flow angles as function of M2, S/c & gamatg FIG. 7 e3 Profile: Loss characteristics as function of inlet angle & gamatg FIG. 8 e3 Profile: Outlet flow angle as function of inlet angle & gamatg FIG. 9 e3 Profile: Loss characteristics as function of Gamatg & M2

FIG. 10 e3 Profile: Outlet flow angle as function of Gamatg & M2

FIG. 11 e9 Profile: Geometrical Ratios

FIG. 12 e9 Profile: (Stacked View)

FIG. 13 e9 Profile: Loss characteristics as function of inlet angle & gamatg FIG. 14 e9 Profile: Outlet flow angle as function of inlet angle & gamatg FIG. 15 e9 Profile: Loss characteristics as function of M2, s/c & gamatg FIG. 16 e9 Profile: Outlet Flow angles as function of M2, s/c & gamatg FIG. 17 e9 Profile: Loss characteristics as function of Gamatg & M2

FIG. 18 e9 Profile: Outlet Flow angle as function of Gamatg & M2

The Profile Geometry: FIG. 1 indicates a typical profile geometry L (or C) denotes the length of base chord, Diameters of leading edge circle, nearly the largest in-circle and trailing edge circles, are denoted by d1, D and d2. The peak locations (maximum height) of suction and pressure faces are denoted by (11,b1) and (12,b2); respectively. The coordinates of center of largest in-circle is (13,b3). B4 is the difference (b1−b2). The vertical shift of lowest point at trailing edge (pressure face) from base line is denoted by b5. Pitch s is the circumferential distance between two adjacent blades in a turbine blade row. It is defined mathematically as S=2 nr/z; r being section radius of the blade where profile section is taken and z is no of blades in the blade-row. Blade turning angle (from inlet edge to outlet edge) is called as camber angle.

Performance Analysis: The proposed blade profiles are analyzed by a CFD (Computational Fluid Dynamics) software for various flow conditions to simulate incompressible as well as subsonic flow regime. The profiles are numerically experimented for a set of stagger angle y,tg (gamatg); pressure ratios (hence exit Mach no.), inlet flow angles and pitch-by-chord ratios to result outlet flow angles β2,tg (or beta2*x*) and energy loss coefficient. In total; result from 148 successful CFD runs are included herein to establish the nomograms.

Energy loss coefficient is defined as $$\varsigma = 1 - \left\{1 - (p2/po2)^{\frac{k-1}{k}}\right\} \Big/ \left\{\left\{1 - (p2/po2)^{\frac{k-1}{k}}\right\}\right.$$

Where p2 is mass-averaged static pressure at the outlet; po1 and po2 are mass averaged stagnation pressure at the inlet and exit of the cascade. K is the ratio of specific heats of working fluid (1.4 for air). Also note that beta2*x*=β2,tg−90; beta1*x*=90−β1,tg. It may be noted that the results quoted herein for energy loss coefficient ζ, is more indicative in nature than the absolute value, since it may vary quantitatively with the use of other CFD software. However the graphical patterns may not change significantly.

The reference blade profile e3:

1. Geometry: FIG. 3 indicates a typical profile geometry e3 having profile thickness value as 38% of chord located at 25% of chord distance from the leading edge. Other geometrical ratios are also shown in the same figure. The unique geometrical feature of the base profile is that the trailing edge (depth b5) is below the base line. The stacked views of profiles for 2 extreme stagger angles (gamatg=43 and 63 degrees) are shown in FIG. 4.
2. Performance Analysis: The first proposed blade profile is analyzed and results are shown in graphical forms for quick use during design. (FIGS. 5–10).

FIGS. 5 and 6 show the effect of exit Mach number M2; pitch-chord ratio s/c and two useful extreme range of stagger angles; gamatg (47 and 57 deg) on energy loss coefficient ζ and outlet flow angles (beta2*x*). The range of s/c and M2 chosen is very wide: 0.65–1.05 and 0.3 to 1.2; respectively. The following observations may be noted:

1. Higher the stagger angle, the lower is the loss at every exit Match on M2
2. Loss increases with M2 except at s/c=0.65 and gamatg=57
3. The suggested profile is useful for a range for a range of M2(M<0.9)
4. Loss is minimum for s/c=0.85 and any M2 (N2<0.9)
5. Loss is maximum for s/c=0.65 for any M2 (M2<0.7) and also for s/c=1.05 for a M2; M2>0.7
6. Exit flow angle beta2*x* decreases with increase in M2 for M2=0.9 and below. The trend is opposite for M2>0.9
7. Higher the stagger, the higher the exit flow angle beta2*x*
8. Beta 2*x* increases with increase in pitch-chord ratio s/c.
9. FIGS. 5 and 6 indicate that s/c=0.85 is optimum ratio, from the point of view of loss.

FIGS. 7 and 8 show the behavior of profile for various inflow angle (incidence effects). The loss is independent of large variation of beta1*x* (−10 to 30 degree) for both extreme stagger (gamatg=47 and 57) at s/c=0.85 and M2=0.6. Similarly there is very negligible change in outlet angle for a large variation in beta1*x*. The trend is valid for other M2 and intermediate stagger angles. FIGS. 9 and 10 are summary nomograms of performance for optimum pitch chord ratio=0.85. They indicate that the profile is useful for stagger angle range 47–63 resulting beta2*x*=−76 to −60 for exit Mach no. range M2=0.3–0.9.

The invented blade profile e9:

1. Geometry: FIG. 11 indicates a typical profile geometry e9 having profile thickness value as 33% of chord located at 27.8% of chord distance from the leading edge. Other geometrical ratios are also shown in the same FIG. It is more cambered profile then e3 hence useful for low reaction blade. The unique geometrical feature of the base profile is that the trailing edge (depth b5) is below the base line. The stacked views of profiles for 2 extreme stagger angles (gamatg=50 and 70 degrees) are shown in FIG. 12.

II. Performance Analysis: The first proposed blade profile is analyzed and results are shown in graphical forms for quick use during design (FIGS. 13–18).

This profile shows the outlet angle variation independent of inlet flow angle (10–50 degree) for two extreme stagger angles 57 and 67 degrees for s/c=0.85 and M2=0.6. However, there is noticeable variation in loss coefficient and outlet angles as function of M2, s/c and stagger angles is shown in FIGS. 15 and 16. There is little variation in beta2*x* for M2=0.9 and below. Beta2*x* increases with M2 for M2>0.9. Energy loss coefficient is minimum for s/c=0.85 for M2<0.9 and below. Two summary performance graphs are shown for optimum s/c=0.85 in FIGS. 17 and 18. Profile behavior is reasonably good for stagger angle range 57–67 covering beta2*x*=−75 to −65 with relatively low loss. Thus with the help a pair profiles e3 and e9, a range of inlet flow angles (10 to 50 degrees), exit Mach numbers (0.3 to 0.9) and stagger angles (47 to 67 degrees), the requirement of cylindrical blades with low energy loss can be accomplished.

I claim:

1. A cylindrical blade for a range of stagger setting (57 to 67 degrees) and exit subsonic Mach number flows (M2<0.9) for axial steam turbines comprising a leading edge and a trailing edge and a pressure face and joining at said trailing and leading edges and an inlet flow angle characterized in that the trailing edge is below a base line by 2.68% of chord length L wherein the base line is a straight line between the furthest upstream point and downstream point of the blade, wherein the curvature of the pressure face has a point of inflection in the area adjacent to said leading edge at 11% of chord length downstream and wherein the curvature at the point of inflection is concave while the curvature downstream of the point of inflection is convex, said leading and trailing edges are defined by circular arcs of diameters d1 and d2, respectively, and wherein the cylindrical blade has a profile thickness (b4/L=0.27812) and a maximum thickness (D/L=0.3296).

2. A cylindrical blade for axial steam turbines as claimed in claim 1 wherein the profile of the blade is defined by the following ratios: D/L=0.329558, d1/L=0.051, d2/L=0.006, b1/L=0.49078, b2/L=0.212665, b3/L=0.321576, b4/L=0.27812, b5/L=0.0268, 11/L=0.277689, 12/L=0.49412, 13/L=0.2460, A/(D*L)=0.63114, Camber angle 110 degrees.

* * * * *

UNITED STATES PATENT AND TRADEMARK OFFICE

CERTIFICATE OF CORRECTION

PATENT NO. : 7,179,058 B2
APPLICATION NO. : 10/861602
DATED : February 20, 2007
INVENTOR(S) : Chandraker It is certified that error appears in the above-identified patent and that said Letters Patent is hereby corrected as shown below:

Column 3, Line 38, the following formula:

$$\zeta = 1 - \{1 - (p2/po2)^{\frac{k-1}{k}}\} / \{\{1 - (p2/po2)^{\frac{k-1}{k}}\}$$

should read:

$$\zeta = 1 - [1 - (p2/po2)^{\frac{k-1}{k}}] / [1 - (p2/po1)^{\frac{k-1}{k}}]$$

Signed and Sealed this

Nineteenth Day of June, 2007

JON W. DUDAS
*Director of the United States Patent and Trademark Office*